US005383659A

United States Patent [19]

Taylor

[11] Patent Number: 5,383,659

[45] Date of Patent: Jan. 24, 1995

[54] COMBINATION GOLF BALL PICK-UP AND TEEING DEVICE

[76] Inventor: Clarence R. Taylor, 28 Woodside Dr., Penfield, N.Y. 14526

[21] Appl. No.: 235,973

[22] Filed: May 2, 1994

[51] Int. Cl.[6] ..... A63B 57/00; A63B 47/02

[52] U.S. Cl. ..... 273/32 B; 294/19.2

[58] Field of Search ..... 294/19.2, 19.3; 273/32 B, 162 E, 201; 473/127

[56] References Cited

U.S. PATENT DOCUMENTS

| | | | |
|---|---|---|---|
| 971,080 | 9/1910 | Roop | 473/127 |
| 3,579,894 | 5/1971 | Kidder | 294/19.3 |
| 4,313,604 | 2/1982 | Baxter | 294/19.2 X |
| 4,819,938 | 4/1989 | Hill | 273/32 B X |
| 5,165,744 | 11/1992 | Vogrin | 273/32.5 X |

*Primary Examiner*—George J. Marlo
*Attorney, Agent, or Firm*—Steve W. Gremban

[57] ABSTRACT

A combination golf ball pick-up and teeing device providing means for simplifying and improving a golfers practice routine. The pick-up and teeing device comprises a needle mounted for reciprocal movement within a shaft. One end of the shaft is placed into engagement with a golf ball and the needle pressed into it for releasably securing the ball to the shaft end for ball pick-up. The pick-up and teeing device can then be used to transfer the picked-up ball onto a mounted tee.

12 Claims, 1 Drawing Sheet

COMBINATION GOLF BALL PICK-UP AND TEEING DEVICE

BACKGROUND OF THE INVENTION

1. Field of the Invention

This invention relates generally to the game of golf and more specifically to the need of practice by any golfer who aspires to improve both his game and his scoring ability. Much of the time, golfing practice involves stooping either to put a tee into the ground or a golf ball onto a tee and the stooping is often more tiring than the striking of the ball once it is on the tee. Anything that would alleviate the stooping problem would enhance a golfer's practice routine and encourage him to do more of it.

2. Description of the Prior Art

As indicated above, most golfers who practice today have no alternative but to go through the tiring routines of stooping over to put tees into the ground and golf balls onto the tees since there are no real practical devices on the market for them to do otherwise. Many devices have been patented to serve this purpose but none show up on the marketplace for one reason or another and the few mechanical devices that have shown up have proven to be quite impractcal because of batteries and/or flimsiness.

SUMMARY OF THE INVENTION

In accordance with preferred embodiments of the invention, a sharp-pointed needle device moveably spring mounted inside a golf ball entrapment housing is fixedly fastened to the bottom end of a long tapered hollow steel shaft. On the top end of the shaft, a rubber composition hand grip and an actuating thumb knob are mounted coupled to the needle device for picking up a loose golf ball and for depositing the ball onto a preset rubber or wood tee, using only one hand. This combination golf ball pick-up and teeing device provides means whereby a golfer, using one hand only, grasps the hand grip upper end of the shaft and applies the entrapment housing on the bottom end to a loose golf ball on the ground, matt, or basket, to entrap it. By means of the thumb knob mounted conveniently in the hand grip, the golfer can force the sharp needle into the surface of the entrapped ball a sufficient distance to hold it firmly but not so deep as to damage the ball in any way. The depth of needle penetration is determined by a stop on the travel of the thumb knob. The gripped ball is transferred onto a preset tee where the ball is released by releasing the thumb knob to withdraw the needle from the ball.

It is accordingly one of the objects of the invention to provide for the golfer a sharp-needle pointed device on the. bottom end of a long hollow steel shaft which enables him to pick up from the ground, matt or basket, a loose golf ball without having to stoop, and thereafter deposit the ball on a preset wood or rubber tee, and by the use of only one hand.

Another object of the invention is to provide for the golfer a device that relieves him of the chore of stooping to pick up golf balls and placing the golf balls on the tees, and thereby provides more of his practice time for just striking the golf ball.

Another object of the invention is to provide a device for simplifying a golfer's practice routine that is easy to use and economical to buy mainly because of it's simple, uncomplicated design and construction.

Another object of the invention is to provide a device that simplifies the positioning of a captured golf ball onto a fixed tee because it is released onto the tee by simply with-drawing a sharp-needle pointed gripper which does not affect the balls position; whereas the ball has to be pushed from other types of grippers to be released, whereby it tends to be pushed off the tee.

Another object of the invention is to provide a device which lets a golfer place a golf ball on a tee without stooping and one which does not in any way physically damage the ball, but which does provide the latitude of picking up any and all golf balls including those out of round or covered with dirt or even having cuts and bruises.

The invention and its objects and advantages will become more apparent from the detailed description of the preferred embodiments presented below.

BRIEF DESCRIPTION OF THE DRAWINGS

In the detailed description of the preferred embodiments of the invention presented below, reference is made to the accompanying drawing, in which.

DESCRIPTION OF THE PREFERRED EMBODIMENTS

Figure 1:
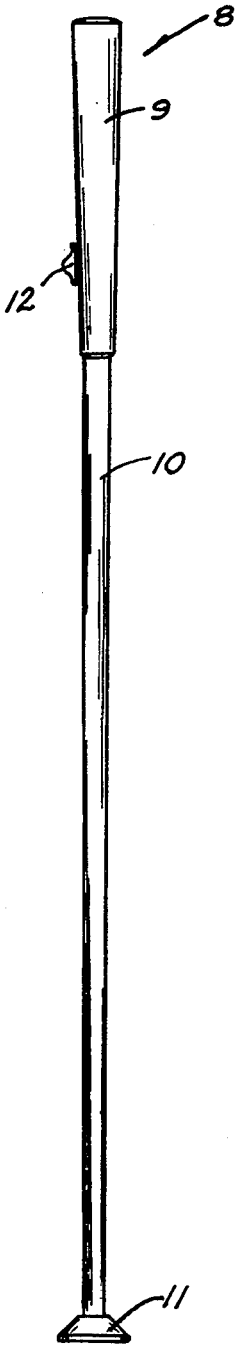
FIG. 1 is a partial scale side view of a preferred embodiment of the combination golf ball pick-up and teeing device
Figure 2:
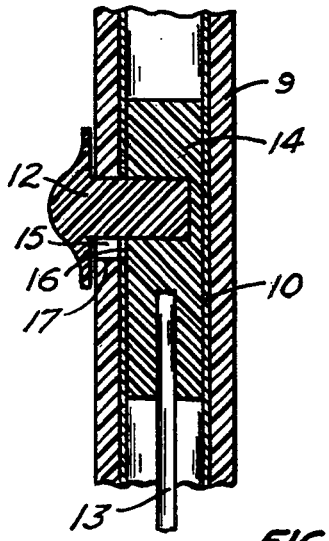
FIG. 2 is a segmented full size sectional view of part of the hand grip and thumb knob mechanism of the device shown in FIG. 1.
Figure 3:
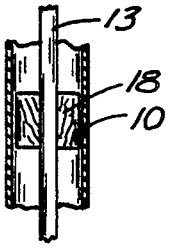
FIG. 3 is a segmental full sized sectional view of part of the tapered hollow shaft of the device shown in FIG. 1 showing one of the spacers used to keep the actuating rod from bending under stress.
Figure 4:
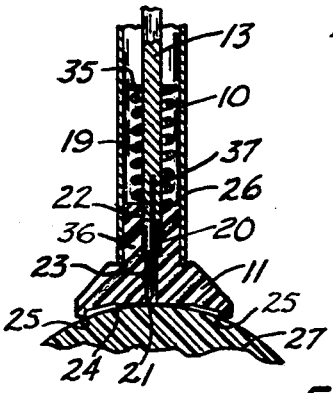
FIG. 4 is a segmental full sized sectional view of the bottom of the hollow shaft shown in FIG. 1 including the golf ball entrapment housing, the spring loaded sharp-needle point in a fully retracted position and a portion of an entrapped golf ball.
Figure 5:
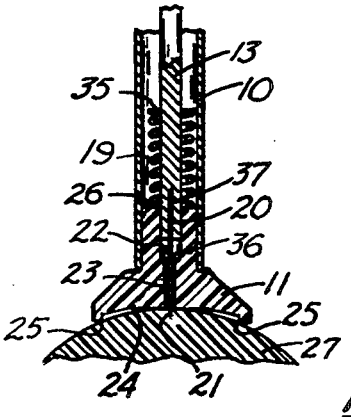
FIG. 5 is a segmental full sized sectional view similar to that in FIG. 4 with the exception that the spring loaded sharp-needle point has been forced by the thumb knob into the surface of an entrapped golf ball to firmly grip the golf ball.

The combination golf ball pick-up and teeing device 8 shown in FIG. 1 comprises a hollow tapered steel shaft 10 having a rigid plastic golf ball entrapment housing 11 on the bottom end and a composition rubber hand grip 9 on the opposite bop end. A plastic thumb knob 12 is slideably mounted within the top end. FIG. 2 is a segmental full sized sectional view of part of the composition rubber hand grip 9 shown in FIG. 1, and steel shaft 10 to which it is permanently cemented. Housed within hollow shaft 10 is a plastic or wood sliding member or slider 14 to which is permanently cemented thumb knob 12 and a sharp-needle actuating steel rod 13. Thumb knob 12 slides freely in a slot 15 of hand grip 9 and matching aligned slot 16 of steel shaft 10 between a top shoulder of the slot and a bottom shoulder 17. As will be explained below, this bottom shoulder 17 of slots 15 and 16 determines the depth of penetration of sharp-needle point 21 into a golf ball in order to prevent any physical damage to the ball. FIG. 3 is a segmental full sized sectional view of steel shaft 10 of FIG. 1 and shows one of a number of wood spacers 18 cemented to actuating rod 13 and very loosely fitted into shaft 10 to serve the purpose of preventing actuating rod 13 from excessive bending as longitudinal stress is put on it at the time the sharp-needle point 21 is forced into an entrapped golf ball 27 shown in FIGS. 4, 5 & 7. FIG. 4 is a segmental full sized sectional view of the bottom end of steel shaft 10 of FIG. 1 to which is permanently fastened by cement a cylindrical end 36 of plastic golf ball entrapment housing 11. Cylindrical end 36 has a central bore 22 for slideably receiving the bottom end of steel actuating rod 13. The bottom end of rod 13 has a hole 37 into which a sharp-pointed preferably tempered steel needle 20 is permanently cemented. The needle 20 is slideably moveable within a central hole 23 in housing 11 in alignment with bore 37. Needle 20 and rod 13 are shown in a fully retracted position in FIG. 4 by means of a spring 19 acting between a tom surface 26 of end 36 of golf ball entrapment housing 11 and lock ring 35 suitably positioned on actuating rod 13. A segmental sectional view of golf ball 27 is shown entraped between surfaces 24 and 25 of the cup-shaped end of entrapment housing 11 prior to being pierced and gripped by sharp-point 21 of needle 20. FIG. 5 is a similar sectional view to FIG. 4 with the exception that it shows the entraped golf ball 27 being firmly gripped for pick-up by sharp point 21 of needle 20 which has been forced into its surface by means of thumb knob 12 and connecting actuating rod 13. The needle point 21 is forced into ball 27 a finite depth as determined by limiting shoulder 17 of hand grid 9 and knob 12 on steel shaft 10. Spring 19 is shown in a compressed condition at this stage and remains that way until golf ball 27 is positioned over a preset tee, not shown, and released thereon by withdrawal of sharp-needle point 21 from the ball through thumb action on thumb knob 12 and connecting actuating rod 13. The spring 19 returns rod 13 and needle 20 to its original position as shown in FIG. 4 in which the sharp-pointed needle 20 is kept out of harms way.

Figure 6:
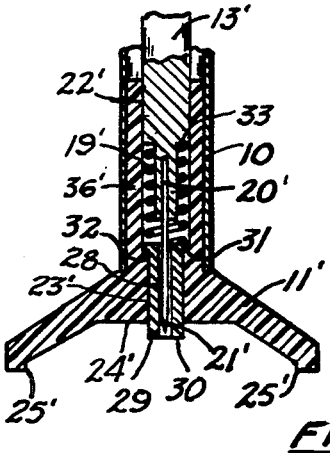
FIG. 6 is an enlarged sectional side view of an alternate design of the golf ball entrapment assembly shown in FIG. 4 in which a safety device is included to ensure the sharp-needle point can only protrude if an entrapped golf ball is in place.
Figure 7:
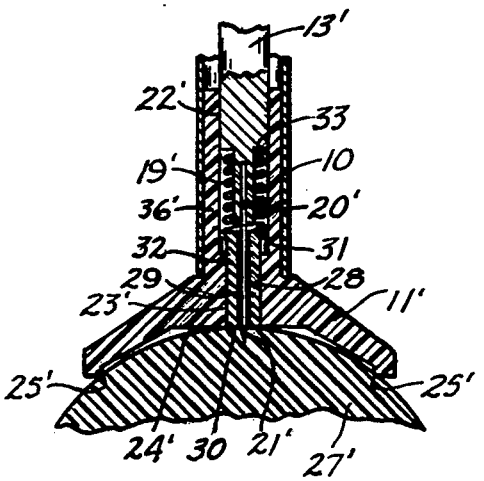
FIG. 7 is an enlarged sectional side view similar to that of FIG. 6 except an entrapped golf ball is in place, the safety device has been pushed back into the entrapment housing and the sharp-needle point has been forced by the thumb knob into the surface of the golf ball to firmly grip it.

FIGS. 6 & 7 show segmental enlarged sectional views of an alternate design of the invention in which like parts are denoted by the same numerals primed. The plastic golf ball entrapment housing 11', shown as 11 in FIG. 1 includes an additional feature of a steel sleeve 28 slideably mounted for movement between forward and backward positions in a central hole 23' in housing 11'. The sleeve 28 provides further protection for sharp-pointed and tempered steel needle 20' which slides freely in a hole 29 of sleeve 28. The sharp point 21' of needle 20' can only emerge when a golf ball 27' is entrapped by edges 24' and 25', as shown in FIG. 7, to engage end surface 30 of sleeve 28 and push the sleeve into its backward position against the bias of spring 19' when downward pressure is exerted on hand grip 9. The sharp-needle point 21' is then forced into golf ball 27' by downward movement of thumb knob 12' and actuating rod 13' which slides freely in hole 22' in golf ball entrapment housing 11'. As shown in FIG. 6, when no golf ball is in an entrapped position, sleeve 28 is moved under the bias of spring 19' into its normal forward position beyond the furthest extension of needle point or tip 21' and gives it added protection against harm. Annular shoulder 31 on sleeve 28 matches annular shoulder 32 on golf ball entrapment housing 11' to provide a stop and to keep sleeve 28 in place. Spring 19' is retained between shoulder 33 on actuating rod 13' and the top surface of annular shoulder 31 of sleeve 28.

The invention has been described in detail with particular reference to preferred embodiments thereof, but it will be understood that variations and modifications can be effected within the spirit and scope of the invention described hereinafter.

I claim:

1. A combination golf ball pick-up and teeing device comprising:

a shaft having a handle at one end and a hollow portion at the opposite end;

a rod slideably mounted within said hollow portion of said shaft for movement between a normal retracted position and an extended position;

an actuating member mounted on one end of said rod for moving said rod between said normal retracted and extended positions; and a needle mounted on the opposite end of said rod adapted to penetrate a golf ball for releasably holding the golf ball in a picked-up position when said opposite end of said hollow portion is placed into engagement with the golf ball and said rod is moved to its extended position, and said needle adapted to be retracted into said hollow portion for releasing the golf ball in a teed position when said rod is moved to its normal retracted position.

2. A combination golf ball pick-up and teeing device according to claim 1 wherein said hollow portion of said shaft and said handle are provided with aligned slots; and wherein said rod actuating member extends through said slots and has one end of said rod actuating member secured to said rod and the opposite end of said rod actuating member forming a thumb actuating knob.

3. A combination golf ball pick-up and teeing device according to claim 2 wherein said aligned slots define a shoulder that is engageable by said rod actuating member for limiting how far said needle penetrates a golf ball when said rod is moved to its extended position.

4. A combination golf ball pick-up and teeing device according to claim 1, and further comprising a golf ball entrapment member mounted on said opposite end of said shaft.

5. A combination golf ball pick-up and teeing device according to claim 4 wherein said golf ball entrapment member has a cup-shaped end.

6. A combination golf ball pick-up and teeing device according to claim 5 wherein said golf ball entrapment member has a central hole through which said needle is slideably moved.

7. A combination golf ball pick-up and teeing device according to claim 6 wherein said golf ball entrapment member has an opposite cylindrical end secured to said opposite end of said shaft, said cylindrical end further having a central bore for slideably receiving said opposite end of said rod.

8. A combination golf ball pick-up and teeing device according to claim 5 wherein said cup-shaped end of said golf ball entrapment member has a central hole, a sleeve mounted within said hole for reciprocal movement between a normal forward position and a backward position, and for receiving said needle and accommodating slideable movement of said needle, and resilient means interposed between said opposite end of said rod and said sleeve for biasing said sleeve into its normal forward position for encircling and protecting the tip of said needle.

9. A combination golf ball pick-up and teeing device according to claim 8 wherein said golf ball entrapment member has an opposite cylindrical end secured to said opposite end of said shaft, said cylindrical end further having a central bore for slideably receiving said opposite end of said rod.

10. A combination golf ball pick-up and teeing device according to claim 1, and further comprising resilient means interposed between said rod and said shaft for biasing said rod to its normal retracted position.

11. A combination golf ball pick-up and teeing device according to claim 1, and further comprising a golf ball entrapment member mounted on said opposite end of said shaft, said golf ball entrapment member having a rigid cup-shaped end for entrapping a golf ball and an opposite cylindrical end secured to said opposite end of said shaft, said cylindrical end further having a central bore for receiving said opposite end of said rod, said cup-shaped end further having a central hole in alignment with said central bore through which said needle is slideably moved; said combination golf ball pick-up and teeing device further comprising resilient means interposed between said rod and said cylindrical end of said entrapment member for biasing said rod to its normal retracted position; and wherein said hollow portion of said shaft and said handle are provided with aligned slots defining upper and lower shoulders, and wherein said rod actuating member extends through said slots and has one end of said rod actuating member secured to said rod and the opposite end of said rod actuating member forming a thumb actuating knob whereby said knob and said rod are biased by said resilient means into engagement with said upper shoulder for holding said rod in its normal retracted position, and said knob is movable against the bias of the resilient means into engagement with said lower shoulder for limiting how far said needle penetrates a golf ball when said rod is moved to its extended position.

12. A combination golf ball pick-up and teeing device according to claim 11 wherein a ring is mounted on said rod, and said resilient means comprises a helical spring encircling said rod and having one end of said spring engaging said ring and the opposite end of said spring engaging said cylindrical end of said entrapment member.

* * * * *